United States Patent [19]

von Zweck

[11] 4,096,352

[45] Jun. 20, 1978

[54] ELECTRICAL FEEDTHROUGH

[76] Inventor: Heimart von Zweck, 221 Mount Auburn St., Cambridge, Mass. 02138

[21] Appl. No.: 742,780

[22] Filed: Nov. 18, 1976

[51] Int. Cl.[2] ..... H01B 17/30

[52] U.S. Cl. ..... 174/153 R; 339/130 R; 339/198 C; 339/198 E

[58] Field of Search ..... 174/18, 152 R, 153 R; 339/126 R, 129, 130 R, 130 C, 132 R, 198 R, 198 C, 198 E, 214 R, 214 C, 218 R, 218 M

[56] References Cited

U.S. PATENT DOCUMENTS

| | | | |
|---|---|---|---|
| 2,457,535 | 12/1948 | Diethert | 174/153 R |
| 2,613,245 | 10/1952 | Brouillette | 339/130 C X |
| 3,059,231 | 10/1962 | Arneberg et al. | 174/152 R X |
| 3,422,392 | 1/1969 | Woods | 339/218 M X |

FOREIGN PATENT DOCUMENTS

| | | | |
|---|---|---|---|
| 476,335 | 7/1915 | France | 174/152 R |
| 1,018,184 | 10/1952 | France | 174/152 R |
| 1,079,048 | 5/1954 | France | 174/152 R |
| 1,145,686 | 3/1963 | Germany | 174/152 R |

*Primary Examiner*—Laramie E. Askin
*Attorney, Agent, or Firm*—Wolf, Greenfield & Sacks

[57] ABSTRACT

Electric feedthrough for use in gastight enclosures has a generally cylindrical, molded body with a molded housing head carrying screw-type electrical connections. An O-ring is situated between the head and a nut threaded to mate with the threads on the housing body so that the nut can be screwed up to form a hermetic seal in the barrier wall of an opening. The screw-type terminations are located at radial distances from the center of the body at least as great as the radius of the body passing through the barrier wall.

4 Claims, 3 Drawing Figures

ELECTRICAL FEEDTHROUGH

BACKGROUND OF THE INVENTION

Electrical feedthroughs for conducting current across gastight barriers are well-known in the art for a variety of different applications. They normally comprise one or more electrical conductors carried by an insulating housing which is fit into an appropriately sized opening in a barrier wall so as to provide a means of conducting current across the barrier. Linear style feedthroughs are generally rectangular in plan and are difficult to seal in gastight seals; thus, it is more often that one finds generally cylindrical body feedthroughs where hermetic seals are necessary. Cylindrical-type feedthrough housings are often made of glass, metal or ceramic and metal combinations. These materials are brittle and such feedthroughs are fragile and expensive.

Ceramic and glass feedthroughs sometimes cause problems of sealing with particular barrier walls due to the various attachments and techniques which must be employed to achieve effective seals. Welding, brazing, soldering and the like are sometimes used.

In more recent times feedthroughs having plastic molded housing have been used with various types of sealing means including various O-ring arrangements.

Often plastic molded feedthroughs employ wires, lugs or pins or a combination thereof which require separate mechanical means for securing the electrical connection effected through these elements. Sometimes it is even necessary to provide a separate plug or socket to contact the feedthrough and carry a plurality of leads to another location where the leads are spread apart as by a terminal block construction to allow interconnection with other electrical devices or to provide for strain relief of the lead wires.

SUMMARY OF THE INVENTION

It is an important object of this invention to provide an electrical feedthrough which can be mounted in gastight relationship with a barrier wall to provide for transmission of electricity therethrough by a plurality of leads which feedthrough is durable, fluid impervious, relatively inexpensive, easy to install and effective.

Still another object of this invention is to provide a feedthrough in accordance with the preceding object which can enlarge contact diameter to provide for maximized contact area with a minimized diameter portion passing through the barrier wall, thus minimizing gastight sealing problems and maximizing ease of getting good mechanical and electrical contact at an enlarged head portion of the feedthrough.

The objects, features and advantages of the present invention will be better understood from the following specification when read in conjunction with the accompanying drawings in which.

SUMMARY OF THE INVENTION

An electrical feedthrough for use in transporting electric current across a gastight barrier wall has a molded plastic housing defining a cylindrical threaded body with a central axis. The body has an outer enlarged head defining an outer diameter larger than the diameter of the threaded body and the housing defines an inner end. A plurality of elongated conductors extend through the body and are embedded therein. A plurality of mechanical contact means are electrically and mechanically joined to the conductors at the outer head and are preferably in the form of female threaded attachments to which male hold down contact screws can be attached.

A plurality of the contact means are positioned about the head and are radially spaced from the central body axis by a distance at least as great as the radius of a cylindrical body portion. The head has an outer surface and an inner surface with a sealing ring of flexible material positioned adjacent the inner surface of the head and encircling the body portion. A threaded nut is threaded on the body and can be screwed up the body toward the inner surface of the head so as to insure, in conjunction with the sealing ring, a gastight seal between the feedthrough and an encircling barrier wall when mounted in such walls.

It is a feature of this invention that the feedthroughs can be produced relatively inexpensively by plastic molding techniques and yet can have required mechanical strength and durability. The sealing ring and its positioning allow simple and effective hermetic sealing. Compact electrical termination at one end of the housing is in effect expanded at the outer head enabling enlarged contact areas. The radial distance expansion is at least as great as the girth or diameter of the cylindrical body. Increase in radial distance multiplies by a factor of $\pi$ the area available for contact and thus a fixed number of contacts can be spread further from each other as the radial distance of each from the central axis increases. Thus large areas for each contact are available even in small diameter feedthroughs. The large area available allows use of screw threaded contacts which provide good mechanical and electrical contact of wires or the like without supplementary sockets or terminal blocks. Conventional O-rings can be used and simple pressure seals achieved by tightening of a single nut.

Figure 1:
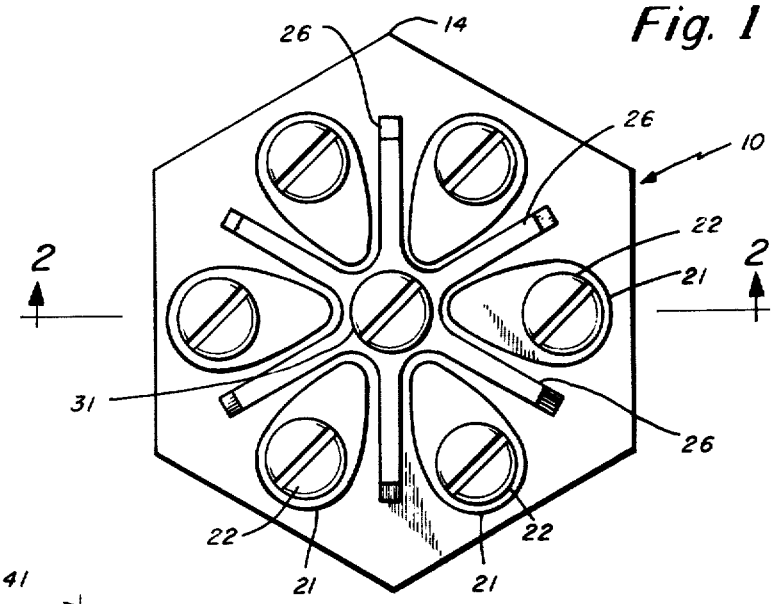
FIG. 1 is a top plan view of a feedthrough housing head of a preferred embodiment of this invention.
Figure 2:
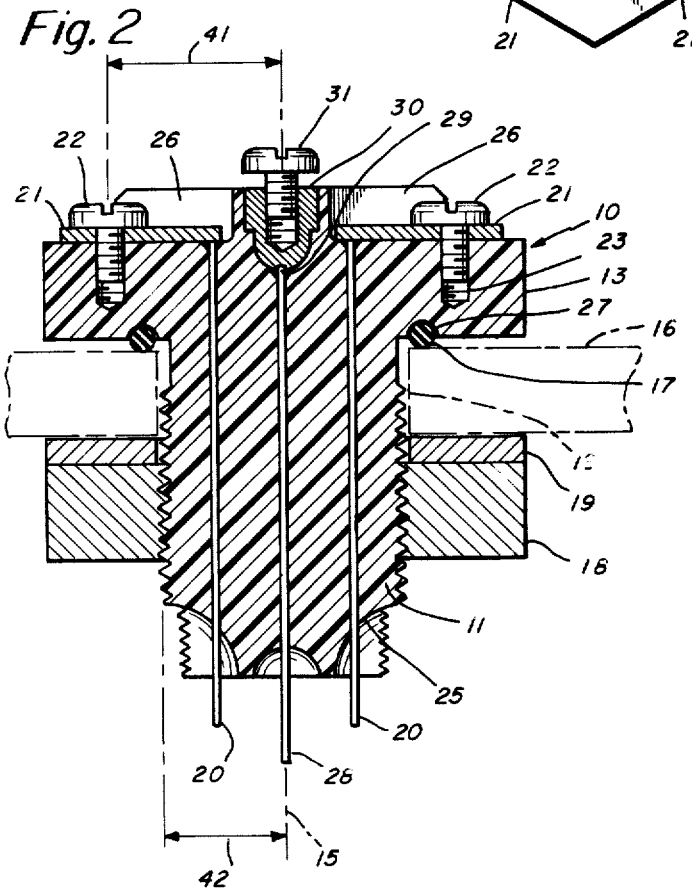
FIG. 2 is a cross-sectional view thereof taken through line 2—2 thereof.

With reference now to the drawings and more particularly FIGS. 1 and 2, a generally screw-shaped electrical feedthrough housing is denoted at 10 which has a generally cylindrical housing body 11 dimensioned to be inserted into a cylindrical barrier wall opening 12. A housing head 13 has a radius at its outermost portions 14 that is larger than the radius of the girth of the body portion 11. The cylindrical housing body 11 has a central axis 15 and is elongated along the central axis for a distance greater than the thickness of the barrier wall to which it is to be attached in gastight hermetic relationship. The barrier wall is indicated generally at 16.

Between the housing head portion 13 and the outer surface of the barrier wall 16 is positioned a ring of flexible material 17 which encircles the housing body. The ring 17 is preferably mounted in an encircling groove 27 which maintains its radial position even when compressed to form a seal. This ring can be a conventional rubber O-ring adapted to insure gastight seal between the feedthrough and the barrier wall when the ring is compressed as by screwing up of a threaded nut 18. A conventional lock washer 19 can be used in conjunction with the nut 18 to compress the O-ring and form the hermetic seal.

The nut 18 can be of any common material such as metal or plastic. The flexible ring 17 can be a conventional 0-ring made of pliable material such as butadiene, natural or synthetic rubber and the like. The feedthrough housing 10 is preferably a molded insulating material formed of an epoxy plastic. High temperature resistant epoxies, phenolic plastics or other common high mechanical strength insulators such as mica filled plastics, diallylphthalate, melamine or alkyl resins can be used. The feedthroughs can be made inexpensively since the plastics or other materials used are molded directly about and sealed to electrical conductors such as conductors 20 which extend through the housing. Conventional embedding techniques can be used.

The conductors 20 are preferably wires formed of conventional conductor metals such as Oxalloy or other appropriate conductive materials. The conductors can also be in the form of tubes, solid rods or other shapes which are attached to outer or external electrical connections at the housing head 13. The electrical connections or terminations at head 13 preferably comprise sheet metal sockets or collars welded to the conductors as best illustrated at 21 and carrying internal threads for reception of screws 22. The housing head 13 can be internally threaded as at 23 to aid in mechanical locking of the screws 22 in the housing. In some cases, only the collars 21 are threaded although the collars and holes or either can be threaded if desired.

Each screw 22 has a head and at least a partially threaded body. In some cases other mechanical contact means can be used such as bayonet clips or the like. However, in all cases the radius 41 corresponding to the spacing of the screws 22 from the central axis is equal to or greater than the radial distance 42. Thus the distance of the connectors 21 from axis 15, is at least as great as one-half the diameter of the feedthrough cylindrical portion 11. This is important since it means that the external connections are spaced radially outwardly of the actual diameter formed by the circularly arranged wires 20 passing through the feedthrough. This increased radial spacing enlarges the contact area making contact to the screw connectors easier than would otherwise be the case. As the radial distance of the contacts from the center increases, the total area of the head increases by a factor of $\pi$ permitting the use of larger spaces for contact. Large contact areas enhance mechanical and electrical contact. The feedthroughs of this invention provide for good hermetic sealing as well as excellent mechanical and electrical connection at the external surface. When screw connections are used, there is direct contact to each wire over large touching areas of the wire and contact collar 21.

At the inner end of the feedthrough, the conductors 20 preferably emerge from the housing at recessed areas as shown at 25 to enhance ease of attachment of leads by conventional spot welding, wire wrapping, soldering or crimping techniques. Termination at the inner end can also be effected by screw-type mechanism or other means such as a plug and socket arrangement. Both the inner and outer ends of the feedthrough can be equipped with ridges or other elevations such as barriers 26 between the collars or conductors to block straight line paths between two or more of them and thereby impede charge leakage from one to another. The barrier ridges also prevent inadvertent touching of adjacent frayed wires. Barriers 26 are preferably star-shaped in plan and are integrally molded with the housing.

In the preferred embodiment, six cylindrically arranged outer conductors 20 are used along with a central conductor 28. The housing head is hexagonal at its outer periphery. The central conductor 28 is identical to conductors 20 but its outer end 29 is welded to an internally threaded cap nut 30 rather than a collar 21. A screw 31 acts as a terminal as do screws 22.

The shape best shown in FIGS. 1 and 2 provides for seven screw terminations each having a screw 22 or 31 and a collar 21 and respective cap nut 30. The charge leakage preventing barrier ridges 26 radiate out from the central raised terminal screw 31.

In a standard feedthrough of the type illustrated in FIG. 1, the overall length from the inner end to the outer end can be for example 2½ inches with the overall greatest diameter of the hexagonal head being 2 inches, the radius 41 being ¾ inch and the radius 42 being ½ inch. The body is formed of an epoxy which embeds the conductors 20 and 28. The washer 19 and nut 18 are of metal materials while the conductor portions are of copper.

Figure 3:
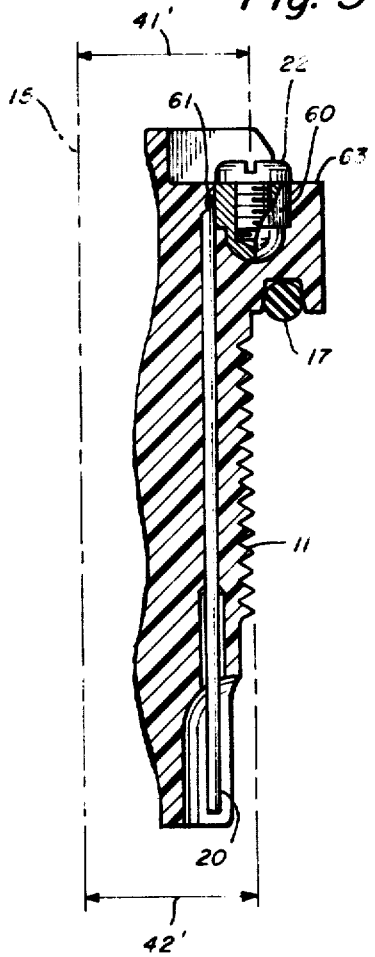
FIG. 3 is a side view of a detail of an alternate embodiment thereof.

FIG. 3 illustrates an alternate construction for forming electrical terminations on the outer face of the housing. All parts of the housing 10 are identical to that described with respect to the embodiment of FIG. 1 except that a metallic cap nut 60 is used in place of each collar 21. Also the comparable radius 41' is ½ inch and the radius 42' is also ½ inch. A conductor 20 is welded at a joint 61 to each cap nut 60 positioned level with the surface 63 of the head 13. This embodiment further simplifies manufacture since the cap nuts prevent plastic flow through to the internal threaded areas as could happen in molding with collars 21. These threaded areas are located directly at the surface of the head.

The particular arrangement of conductors on the face of the feedthrough can vary. While screw-type connections are preferred since good mechanical clamping action as well as electrical contact thereby results, other contacts can be used. In some cases, the threaded portion that extends into what may be a vacuum area is covered with a metal ferrule which itself can be threaded. Furthermore, the conductors carried by the feedthrough may be arranged in bundles as well as singly or doubly. The number of conductors used can vary as can the particular geometry of the head 13.

As mentioned earlier, the feedthroughs of this invention may be employed where different pressures are maintained on either side of the barrier wall, including vacuum work. It is evident that they could also be employed where there is no pressure difference between the two sides of the barrier, although a gastight seal is not normally required in such a situation. The feedthroughs of this invention are useful under conventional high vacuum conditions of for example $10^{-4}$ to $10^{-7}$ mm Hg or higher at temperatures of 72° F. Under such conditions screw-type terminations are especially useful since soft solder should be avoided on the termination due to outgassing problems.

As is shown in the Figures and in the accompanying discussion, the feedthroughs of the present invention constitute simple, economical apparatus eliminating the need for special fittings, machining, soldering, threading, etc. of the barrier wall or of the barrier opening. Furthermore, the screw-type terminations provided on at least the housing head can serve as a means of mechanically securing the outside electrical connectors, as well as effecting connection itself. Another important advantage gained by use of the feedthroughs of this invention is their adaptability to installation in either direction, i.e., they can normally be installed and function in the same manner regardless of whether the housing head is on one side of the barrier wall or the other.

Of course if it is desired, the feedthroughs of this invention and the barrier opening may be equipped with mating threads or other attachments such as the aforementioned washers. In addition to their relatively low cost, simple construction and compactness, the feedthroughs of this invention provide both good electrical insulation and mechanical strength and are much more rugged and less fragile than their glass and ceramic counterparts. Lastly, their screw terminations not only make attachment to outside wires more easily accomplished and more secure, but these terminations reduce the number of necessary parts and require comparatively little room, an important advantage in vacuum and pressure systems with limited space.

Since other changes may be made in the above apparatus without departing from the scope of the invention, it is intended that all matter contained in the above description or shown in the accompanying drawings shall be interpreted as illustrative and not in a limiting sense.

What is claimed is:

1. An electrical feedthrough for use in transporting current across a gastight barrier wall resistant to high vacuum conditions of from $10^{-4}$ to $10^{-7}$ mm of Hg, said feedthrough comprising an insulation housing defining a cylindrical threaded body having a central axis with an enlarged outer head of larger diameter than said body, said housing further defining an inner end, a plurality of elongated conductors extending through said body and embedded therein with individual inner ends thereof extending out of said body inner end at corresponding individual recessed areas defined by said body, said insulation being an epoxy material molded about and sealed to said conductors along the entire length of said conductors in said body, a plurality of mechanical contact means electrically joined to said conductors at said outer head, said plurality of contact means being radially spaced from said body axis by a distance at least as great as the radius of said cylindrical body portion, said head having an outer surface and an inner surface with a sealing ring of flexible material positioned adjacent said inner surface and encircling said body portion, a threaded nut threaded on said body and being screwable up said body toward said inner surface so as to insure, in conjunction with the sealing ring, a gastight seal between the feedthrough and an encircling barrier wall when mounted in said wall with said gastight seal and said feedthrough being hermetically sealed at vacuum conditions of from $10^{-4}$ to $10^{-7}$ mm of Hg.

2. An electrical feedthrough in accordance with claim 1 wherein said head is provided with a screw-type contact for each of said plurality of conductors.

3. An electrical feedthrough in accordance with claim 2 wherein said screw-type contacts are cap nuts embedded in said body with individual outer ends of said plurality of conductors being joined to embedded portions of corresponding individual cap nuts.

4. An electrical feedthrough in accordance with claim 3 and further comprising a central conductor substantially aligned with said central axis, said feedthrough head being configured with an elevated ridge between said screw-type contacts.

* * * * *